US006341609B1

(12) United States Patent
Morris

(10) Patent No.: US 6,341,609 B1
(45) Date of Patent: Jan. 29, 2002

(54) CIGARETTE HOLDER

(76) Inventor: Larry D. Morris, R.R. 1, Box 8A, Blue Springs, NE (US) 68318

( * ) Notice: Subject to any disclaimer, the term of this patent is extended or adjusted under 35 U.S.C. 154(b) by 0 days.

(21) Appl. No.: 09/546,246

(22) Filed: Apr. 10, 2000

(51) Int. Cl.[7] ..... A24F 13/22

(52) U.S. Cl. ..... 131/190; 131/187; 131/257; 131/330; 27/172; 27/183

(58) Field of Search ..... 131/187, 190, 131/175, 240.1, 174; 27/172, 183

(56) References Cited

U.S. PATENT DOCUMENTS

| | | | | | |
|---|---|---|---|---|---|
| 177,456 | A | * | 5/1876 | Blackford | |
| 2,207,197 | A | * | 7/1940 | Havey | |
| 2,580,985 | A | * | 1/1952 | Wooden | |
| 2,826,206 | A | * | 3/1958 | Slater | |
| 3,653,775 | A | * | 4/1972 | Ross | |
| 3,756,252 | A | * | 9/1973 | Vigorito | 131/256 |
| 4,194,516 | A | * | 3/1980 | Morgan | 131/174 |
| 4,281,672 | A | * | 8/1981 | Caraway | 131/174 |
| D272,295 | S | * | 1/1984 | Lewis | D2/400 |
| D311,600 | S | * | 10/1990 | Peracca | D27/183 |
| 5,564,443 | A | * | 10/1996 | Cardenas | 131/256 |
| 5,706,832 | A | * | 1/1998 | Gold | 131/240.1 |
| D406,386 | S | * | 3/1999 | Kuniansky et al. | D27/183 |

* cited by examiner

*Primary Examiner*—James Derrington
*Assistant Examiner*—Carlos Lopez
(74) *Attorney, Agent, or Firm*—Zarley, McKee, Thomte, Voorhees & Sease; Dennis L. Thomte

(57) ABSTRACT

A cigarette holder utilizing the components of a rifle cartridge is disclosed. The rifle cartridge includes a tubular cartridge case having a bullet received therein at one end thereof. An elongated member is secured to the base of the bullet and extends therefrom for connection to an alligator clip. When the holder is not being used, the bullet is inserted into the cartridge case so that the elongated member and alligator clip are positioned within the powder chamber of the cartridge case. When it is desired to use the cigarette holder, the bullet is removed from the case and a cigarette is positioned between the jaws of the alligator clip.

7 Claims, 2 Drawing Sheets

CIGARETTE HOLDER

BACKGROUND OF THE INVENTION

1. Field of the Invention

This invention relates to a cigarette holder and more particularly to a cigarette holder which resembles a rifle cartridge.

2. Description of the Related Art

The fingers of a cigarette smoker frequently become discolored in the areas where the smoker's fingers grasp the cigarette. Further, when the length of the cigarette becomes short, the cigarette is difficult to hold. Many types of cigarette holders have been previously provided, but the same are not easily useable when the cigarette is very short. Further, the conventional cigarette holders are not aesthetically pleasing.

SUMMARY OF THE INVENTION

A cigarette holder is provided wherein the holder, when not in use and in its stored position, resembles a rifle cartridge. The cigarette holder of this invention comprises a tubular cartridge case having a base end, an open neck end for partially receiving a bullet, and a powder chamber; a bullet having a base end and a forward end; the base of the bullet being received in the open end of the cartridge case; an elongated member having first and second ends; the first end of the elongated member being secured to the base end of the bullet; an alligator clip having first and second ends; the first end of the clip being secured to the second end of the elongated member; the alligator clip including movable jaw means at its second end; the clip and the elongated member being positioned in the powder chamber of the cartridge when the base end of the bullet is received in the open neck end of the cartridge case; the bullet, clip and elongated member being removable from the cartridge case to enable a smoker to grasp the bullet and to place a cigarette in the movable jaw means to facilitate the holding of the cigarette.

A principal object of the invention is to provide an improved cigarette holder.

A further object of the invention is to provide a cigarette holder which resembles a rifle cartridge.

A further object of the invention is to provide a cigarette holder which utilizes the actual components, except for the powder charge and primer, of a rifle cartridge.

Still another object of the invention is to provide a cigarette holder which may be used to hold a cigarette so that the smoker's fingers will not become discolored by the cigarette.

A further object of the invention is to provide a cigarette holder which may be used to hold short cigarettes.

Still another object of the invention is to provide a cigarette holder which is economical of manufacture, durable in use and refined in appearance.

These and other objects will be apparent to those skilled in the art.

DESCRIPTION OF THE PREFERRED EMBODIMENT

Figure 1:
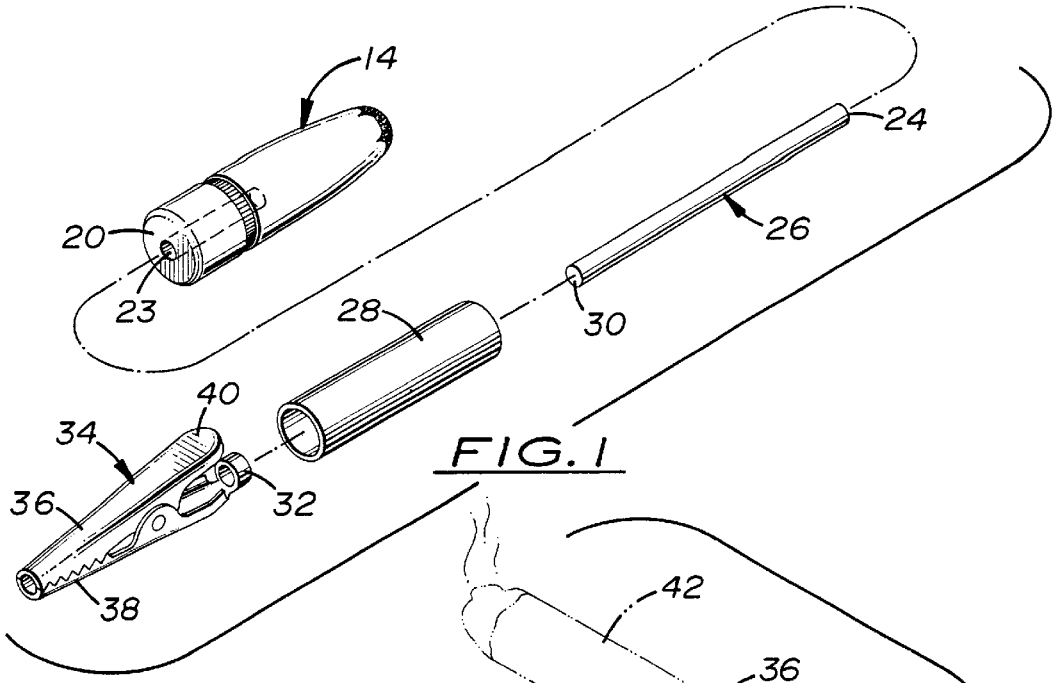
FIG. 1 is a partial exploded perspective view of the cigarette holder.
Figure 2:
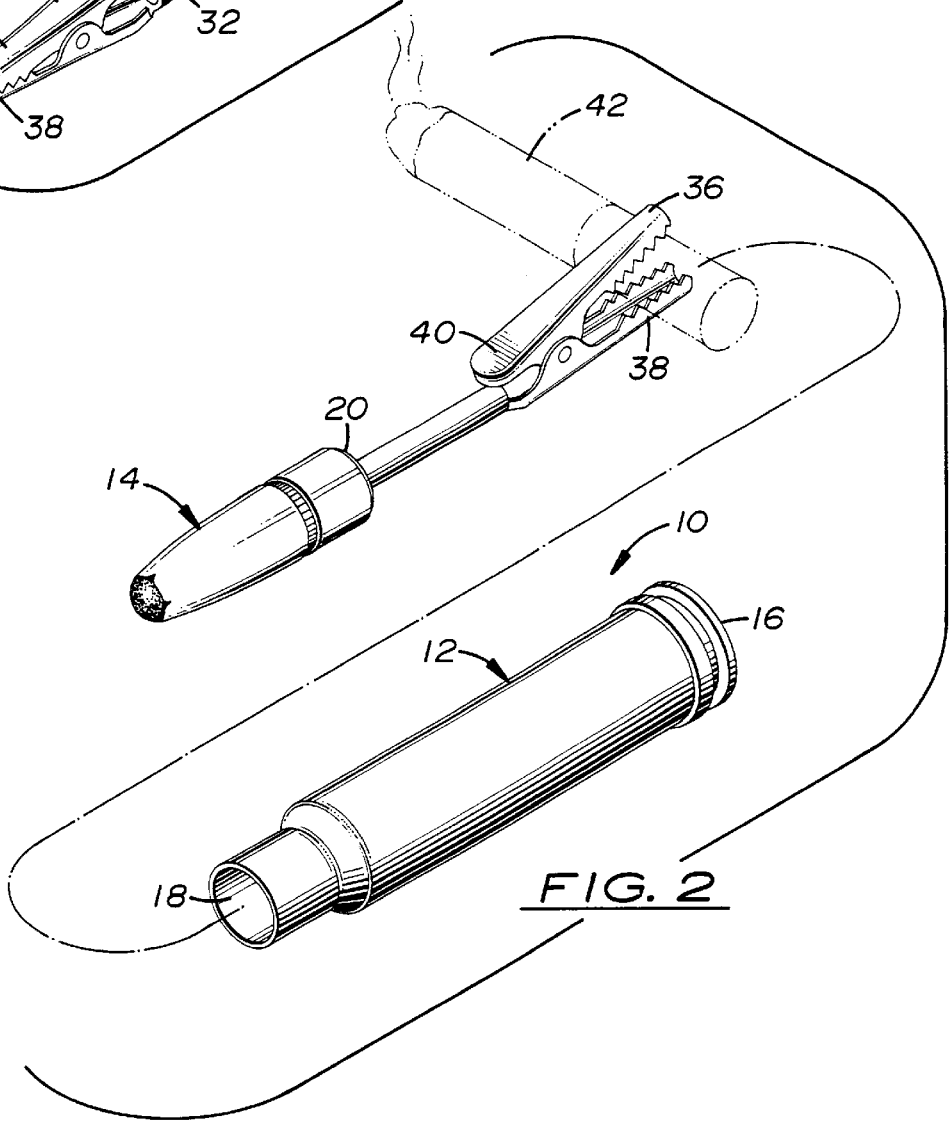
FIG. 2 is a perspective view of the cigarette holder removed from the rifle cartridge case.
Figure 3:
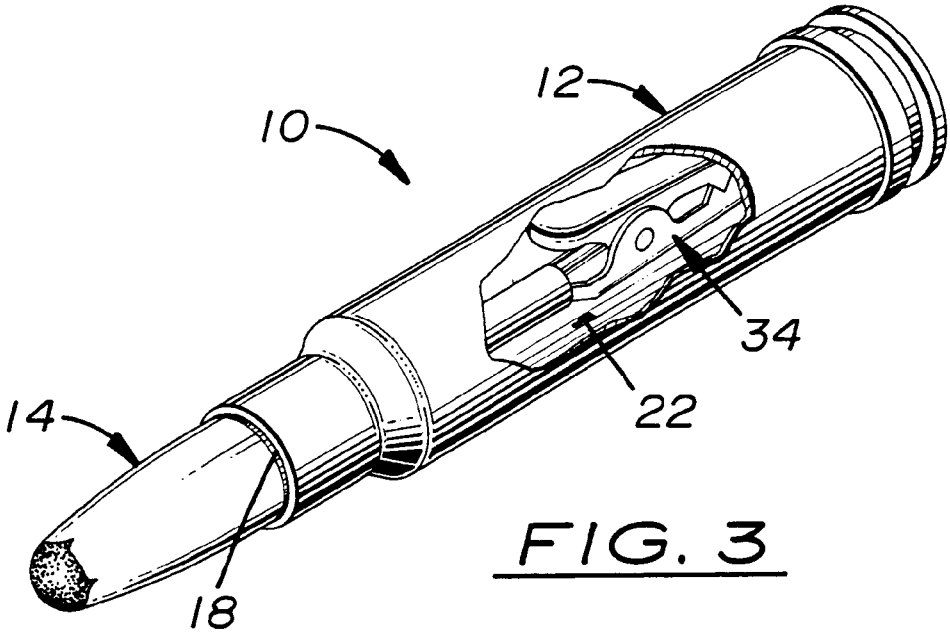
FIG. 3 is a perspective view of the cigarette holder stored in the rifle cartridge case.

The numeral 10 refers generally to a conventional rifle cartridge comprising a cartridge case 12 and a bullet 14. Case 12 includes a base end 16 and an open neck end 18 which is adapted to receive the base end 20 of the bullet 14. Case 12 includes an interior powder chamber 22 which would normally contain the powder charge of the cartridge. A "new" brass cartridge with an inert primer should be used. A person should not attempt to modify a live cartridge.

The base end 20 of bullet 14 is preferably drilled or bored to create a bore 23 therein to enable the end 24 of wire member 26 to be inserted therein so that wire member 26 is secured to bullet 14. Wire member 26 may be either soldered to bullet 14 or glued thereto in conventional fashion. Preferably, plastic sleeve 28 is then mounted on wire member 26 so as to embrace the same. The end 30 of wire member 26 is then secured to the base end 32 of alligator clip 34 having a movable spring-loaded jaw member 36 on its other end which may be moved towards or away from the stationary jaw member 38 through use of the handle 40. End 24 of wire member 26 is secured to alligator clip 34 by soldering or clamping in conventional fashion. The plastic sleeve 28 is then heated to reduce the diameter thereof so that it closely or tightly embraces wire member 26 and the connection of the wire member 26 and the alligator clip 34.

The alligator clip 34 and wire member 26 with sleeve 28 thereon are inserted into the powder chamber 22 until the base end 20 of bullet 14 is received in the open neck end 18 of the bullet 14. When so installed, the assembly looks exactly like a rifle cartridge.

When it is desired to use the assembly as a cigarette holder, the bullet 14, wire member 26 with sleeve 28 thereon, and alligator clip 34 are removed from the case 12. A cigarette 42 may then be placed in between the stationary jaw member 38 and the movable jaw member 36. The smoker may then grasp the bullet 14 and smoke the cigarette. When the smoker has finished smoking the cigarette, the cigarette is extinguished and the butt removed from the alligator clip 34. The holder may then be reinserted into the case 12.

Thus it can be seen that a novel cigarette holder has been provided which looks like a rifle cartridge when not being used and which is conveniently removed from the cartridge case when the smoker desires to smoke a cigarette.

Thus it can be seen that the invention accomplishes at least all of its stated objectives.

I claim:

1. A cigarette holder, comprising:

a tubular cartridge case having a base end, an open neck end for partially receiving a bullet, and a powder chamber with the powder and primer removed;

a bullet having a base end and a forward end;

said base end of said bullet being receivable in said open end of said cartridge case;

an elongated member having first and second ends;

said first end of said elongated member being secured to said base end of said bullet;

a clip having first and second ends;

said first end of said clip being secured to said second end of said elongated member;

said clip including movable jaw means at its said second end;

said clip and said elongated member being positioned in said powder chamber when said base end of said bullet is received in said open end of said cartridge case;

said bullet clip and elongated member being removable from said cartridge case to enable a smoker to grasp said bullet and to place a cigarette in said movable jaw means.

2. The cigarette holder of claim 1 wherein said cartridge case is a rifle cartridge case.

3. The cigarette holder of claim 1 wherein said clip comprises an alligator clip.

4. The cigarette holder of claim 1 wherein said bullet is a rifle bullet.

5. The cigarette holder of claim 2 wherein said bullet is a rifle bullet.

6. The cigarette holder of claim 1 wherein said base end of said bullet has a bore formed therein which receives said first end of said elongated member.

7. The cigarette holder of claim 1 wherein said elongated member comprises a wire member and wherein a sleeve embraces said wire member.

* * * * *